US005997591A

United States Patent [19]

Matsuda et al.

[11] Patent Number: 5,997,591

[45] Date of Patent: Dec. 7, 1999

[54] LIQUID FUEL

[75] Inventors: Masanori Matsuda, 1834-1, Nagahama, Yomitan-son, Nakakami-gun, Okinawa, 903-03, Japan; Hutoshi Matsuda, Okinawa, Japan; Yumiko Matsuda, Okinawa, Japan

[73] Assignee: Masanori Matsuda, Japan

[21] Appl. No.: 09/206,339

[22] Filed: Dec. 8, 1998

Related U.S. Application Data

[63] Continuation of application No. 08/702,601, Mar. 3, 1997, abandoned.

[30] Foreign Application Priority Data

Dec. 27, 1994 [JP] Japan ..... 6-336985
Dec. 27, 1995 [WO] WIPO ..... PCT/JP95/02733

[51] Int. Cl.[6] ..... C10L 1/32
[52] U.S. Cl. ..... 44/301
[58] Field of Search ..... 44/301

[56] References Cited

U.S. PATENT DOCUMENTS 4,244,702 1/1981 Alliger ..... 44/301
4,315,755 2/1982 Hellsten et al. ..... 44/301
4,395,266 7/1983 Han ..... 44/301
4,400,177 8/1983 Cottell ..... 44/301
5,288,295 2/1994 Hypes et al. ..... 44/301

OTHER PUBLICATIONS

Fuels, *Perry's Chemical Engineer's Handbook 6th Edition,* date unavailable.

Standard Specification for Fuel Oils, *An American National Standard publication D 396–96,* Jun. 1996.

Standard Specification for Diesel Fuel Oils, *An American National Standard Publication D 975–96a,* Jan. 1997.

*Primary Examiner*—Jacqueline V. Howard
*Attorney, Agent, or Firm*—McGlew and Tuttle, P.C.

[57] ABSTRACT

A new liquid fuel is prepared by mixing an emulsion which is a mixture of one portion of lubricating oil with not more than three portions of water, into diesel oil, or by adding water to a mixture of A and C heavy oil. The new liquid fuel causes no pollution and maintains internal combustion engines clean with prices inexpensive.

6 Claims, No Drawings

LIQUID FUEL

CROSS REFERENCE TO RELATED APPLICATIONS

This is a continuation of application Ser. No. 08/702,601 filed Mar. 3, 1997, now abandoned.

FIELD OF THE INVENTION

The present invention relates to new liquid fuel such as is used for internal combustion engines including dynamos and Diesel engines, without combustion residues, generating clean exhaust gas with an inexpensive price.

BACKGROUND OF THE INVENTION

A simple substance of Japanese Standard A heavy oil (similar to U.S. Standard No. 2, Grade No. 4 (light) or No. 4), light oil or kerosene is used as fuel for conventional internal combustion engines, for instance, dynamos and Diesel engines.

After combustion the conventional fuel generates combustion products or residues which adhere to the inner surface of the internal combustion engines such that the combustion efficiency is reduced. Further, the products or residues are emitted, contained in the exhaust gas. This poses a pollution problem. To solve these problems, measures including supplying air to combustion chambers, adding other chemical agents to combustion chambers and equipping special apparatus to exhaust pipes have been taken as anti-pollution measures, which have disadvantages of costs for the equipment or the additive chemical agents as well as the resulting reduction of the combustion efficiency.

SUMMARY AND OBJECTS OF THE INVENTION

The present invention therefore provides a new liquid fuel requiring no additional costs for equipment, which new fuel increases the combustion efficiency with low costs. The new liquid fuel is prepared by adding clear water or sea water to lubricating oil, spent waste oil, heavy oil, light oil or kerosene.

The various features of novelty which characterize the invention are pointed out with particularity in the claims annexed to and forming a part of this disclosure. For a better understanding of the invention, its operating advantages and specific objects attained by its uses, reference is made to the accompanying descriptive matter in which a preferred embodiment of the invention is illustrated.

DESCRIPTION OF THE PREFERRED EMBODIMENT

As the mixing ratio of lubricating oil and water for the liquid fuel of the present invention, one portion of lubricating oil to not more than three portions of water is a ratio best suitable in terms of engine efficiency or for the purpose of taking a counterpart against harmful exhaust gas. A mixing ratio of the emulsion, i. e. the mixture of both the oil and water, to the liquid fuel which the emulsion is mixed into, more specifically A heavy oil, light oil or kerosene for diesel engines was determined as not more than one second.

To make this mixing preferable, it is always recommended to stir the mixed solution with a stirring apparatus or to use an aeration device.

An emulsion was prepared by mixing 40–50 weight percent of A heavy oil and 60–50 weight percent of Japanese standard C heavy oil (similar to U.S. Standard No.5 (heavy) and No. 6), and to 75 65 weight percent of the emulsion was added 25–35 weight percent of water.

It should be noted that adding more water than said ratio disturbed the normal work of engines because of incomplete miscibility of water with lubricating oil, waste oil, heavy oil, etc. and of incomplete miscibility of the emulsion with the liquid fuel.

The new liquid fuel of the present invention is not only a generator of combustion which causes no recognizable reduction of engine performance but also a preferable anti-pollution measure. The new liquid fuel generates no combustion products nor residues such as slurry, slug, etc. which have conventionally existed in exhaust gas as particles to be scattered into atmosphere, and none of them are detected in the exhaust gas.

EMBODIMENT 1

As described above, an emulsion prepared by mixing 2 weight percent of waste oil (lubricating oil) and 6 weight percent of clear water or sea water in a constant proportion by stirring was mixed into 160 weight percent of diesel oil, and the mixture was stirred for 40–60 minutes to provide the new liquid fuel. As a result, no difference in engine performance from diesel oil used as fuel was recognized.

The results of an exhausting test were as follows:

| Fuel of the present invention | Japanese Minister of Transport reference value |
|---|---|
| CO (carbon monoxide) 0.07% | (not more than 4.5%) |
| HC (nitrogen carbide) 20 PPM | (not more than 1.200 PPM) |
| DS (black smoke) 5% | (not more than 50%) |

EMBODIMENT 2

An emulsion prepared by mixing 20 weight percent of waste oil (lubricating oil) and 60 weight percent of clear water or sea water in a constant proportion by stirring was mixed into 160 weight percent of diesel oil, and the mixture was stirred for 40–60 minutes to provide the new liquid fuel. As a result, no difference in engine performance from diesel oil used as fuel was recognized.

The results of an exhausting test were as follows:

| Fuel of the present invention | Japanese Minister of Transport reference value |
|---|---|
| CO (carbon monoxide) 0.09% | (not more than 4.5%) |
| HC (nitrogen carbide) 20 PPM | (not more than 1.200 PPM) |
| DS (black smoke) 0% | (not more than 50%) |

EMBODIMENT 3

To a mixture of 40 weight percent of A heavy oil and 60 weight percent of C heavy oil, water was further added and the mixture was stirred to prepare the new liquid fuel. Operating a diesel engine with the new liquid fuel bore exhausting test results similar to those in Example 1.

Mixing ratios other than 40–50 weight percent of A heavy oil to 60–50 weight percent of C heavy oil, and 75–65 weight percent of the mixture to 25–35 weight percent of water resulted in the emission of exhaust gas of white smoke or an unsmooth rotation of engines.

As noted above, Japanese Standard A heavy oil substantially corresponds to U.S. Standard No. 2, Grade No. 4 (light) or No. 4. Japanese Standard C heavy oil substantially corresponds to U.S. Standard No.5 (heavy) and No. 6. The properties of Kerosene, light oil, Japanese Standard A heavy oil and Japanese Standard C heavy oil are generally known in the United States as foreign standards specifications are generally available from the American Standards Institute. The known characteristics are as follows:

| | A heavy oil | C heavy oil |
|---|---|---|
| density (15° C.) | 0.8513 g/cm$^3$ | 0.9285 g/cm$^3$ |
| kinematic viscosity (50° C.) | 3.554 mm$^2$ | 165.7 mm$^2$ |
| flash point PM. | 66° C. | 90° C. |
| sulfur content | 0.47 mas % | 1.48 mas % |
| reaction | neutral | neutral |
| carbon residue content (10% residue oil) | 0.21 mas % | 6.07 mas % |
| ash content | 0.0 mas % | 0.0 mas % |
| moisture content | 0.0 capacity % | 0.0 capacity % |
| moisture and muddy content (impurity) | combined state | combined state |
| flow point | −7.5° C. | −2.5° C. |
| nitrogen content | 0.01 mas % | |
| estimated higher heating value (cal/g) | 45.377 J/g (10.840) | 44.079 J/g (10.530) |
| estimated lower heating value (cal/g) | 42.614 J/g (10.180) | 41.567 J/g (9.930) |
| | **Kerosene** | **light oil** |
| density (15° C.) | 0.7948 g/cm$^3$ 0 | .8272 g/cm$^3$ |
| flash point TG. | 49.0° C. | 69° C. |
| doctor test | negative | |
| distillation characteristics | | |
| initial boiling point | 162.0° C. | |
| 50% | 204.5° C. | 277.0° C. |
| 90% | 241.0° C. | 329.0° C. |
| 95% | 249.5° C. | 341.0° C. |
| end point | 266.5° C. | |
| sulfur content | 0.007% | 0.05% |
| color | +30 | |
| smoke point | 26.0 | |
| cetan index | | 61 |
| carbon residue content (10% residue oil) | | 0.02 mas % |
| flow point | | −2.5° C. |
| corrosion of steel plate 50° C. 3 h | 1A | 1A |
| reaction | neutral | neutral |
| estimated higher heating value (cal/g) | 46.800 J/g (11.180) | 45.084 J/g (10.770) |
| estimated lower heating value (cal/g) | | 41.819 J/g (9.990) |

ADVANTAGES OF THE INVENTION

As described above, mixing the emulsion prepared by mixing lubricating oil (waste oil) and clear water or sea water in a constant proportion into diesel oil made the emulsion and the diesel oil mixed up and provided a new liquid fuel which causes no pollution by combustion.

Also, C heavy oil which conventionally has been utilized only for large diesel engines and large boilers is made available as fuel of internal combustion engines including diesel engines by mixing it with A heavy oil in a constant proportion and further adding water.

Furthermore, the new liquid fuel not only causes no reduction of engine efficiency but also generates no combustion products nor residues, resulting in the maintenance of clear and clean internal combustion engines.

Since the fuel of the present invention is prepared by adding waste oil, heavy oil, especially low-priced C heavy oil and clear water or sea water, costs are largely reduced so much. In modern times when electric power runs short, the power is supplied with at prices which are inexpensive if the new liquid fuel is fed to dynamos. More specifically, electric power is easily supplied without facilities to remote places and solitary islands.

While specific embodiments of the invention have been shown and described in detail to illustrate the application of the principles of the invention, it will be understood that the invention may be embodied otherwise without departing from such principles.

What is claimed is:

1. A liquid fuel prepared by:

mixing 40–50 weight percent of Japanese Standard, A heavy oil with 60–50 weight percent of Japanese Standard C heavy oil to form a mixture;

stirring together 75–65 weight percent of said mixture with 25–35 weight percent water.

2. A liquid fuel according to claim 1, wherein: said water is one of clear water and sea water.

3. A liquid fuel prepared by:

mixing 40–50 weight percent of A heavy oil with 60–50 weight percent of C heavy oil to form a mixture;

stirring together 75–65 weight percent of said mixture with 25–35 weight percent water.

4. A liquid fuel according to claim 3, wherein: said water is one of clear water and sea water.

5. A liquid fuel prepared by: mixing 40–50 weight percent of one of Japanese Standard A heavy oil, U.S. Standard No. 2 oil, U.S. Standard Grade No. 4 (light) oil or U.S. Standard No. 4 oil with 60–50 weight percent of one of Japanese Standard C heavy oil, U.S. Standard No. 5 (heavy) oil or U.S. Standard No. 6 oil to form a mixture;

stirring together 75–65 weight percent of said mixture with 25–35 weight percent water.

6. A liquid fuel according to claim 5, wherein: said water is one of clear water and sea water.

* * * * *